US007284775B2

(12) United States Patent
Bajaj

(10) Patent No.: US 7,284,775 B2
(45) Date of Patent: Oct. 23, 2007

(54) SINGLE ACTION HANDLE MECHANISM FOR OPERATING THE DOOR/WINDOW

(76) Inventor: Rajan Bajaj, C-20, Industrial Estate, Aligarh 202001, U.P. (IN)

( * ) Notice: Subject to any disclaimer, the term of this patent is extended or adjusted under 35 U.S.C. 154(b) by 14 days.

(21) Appl. No.: 10/488,336

(22) PCT Filed: Aug. 28, 2002

(86) PCT No.: PCT/IN02/00174

§ 371 (c)(1),
(2), (4) Date: Oct. 27, 2004

(87) PCT Pub. No.: WO03/018942

PCT Pub. Date: Mar. 6, 2003

(65) Prior Publication Data

US 2005/0066695 A1 Mar. 31, 2005

(30) Foreign Application Priority Data

Aug. 30, 2001 (IN) ..... 896/01

(51) Int. Cl.
*E05B 3/00* (2006.01)
*E05C 1/12* (2006.01)

(52) U.S. Cl. ..... 292/336.3; 292/165; 292/DIG. 65

(58) Field of Classification Search ..... 292/336.3, 292/165, 92, 347, DIG. 65
See application file for complete search history.

(56) References Cited

U.S. PATENT DOCUMENTS 1,544,575 A * 7/1925 Halper ..... 292/165
2,179,430 A * 11/1939 Schmitt ..... 292/173
2,201,444 A * 5/1940 Marsh ..... 292/165
3,249,379 A * 5/1966 Ross ..... 292/166
3,249,380 A * 5/1966 Ross ..... 292/166
3,477,754 A * 11/1969 Check ..... 292/165
4,003,593 A * 1/1977 Wilzig et al. ..... 292/92
4,007,954 A * 2/1977 Erickson ..... 292/165
4,629,228 A * 12/1986 Marko et al. ..... 292/165
4,986,583 A * 1/1991 Campbell et al. ..... 292/336.3
5,058,474 A * 10/1991 Herrera ..... 83/447
5,403,047 A * 4/1995 Walls ..... 292/173
5,730,478 A * 3/1998 D'Hooge ..... 292/348
6,009,932 A * 1/2000 Smith ..... 160/371
6,174,005 B1 * 1/2001 Norton ..... 292/169.21
6,196,599 B1 * 3/2001 D'Hooge ..... 292/165
6,293,598 B1 * 9/2001 Rusiana ..... 292/143

* cited by examiner

*Primary Examiner*—Carlos Lugo
(74) *Attorney, Agent, or Firm*—Allen, Dyer, Doppelt, Milbrath & Gilchrist, P.A.

(57) ABSTRACT

A single action handle mechanism for operating a door/window having at least one handle connected to a cam which operates a spring loaded latch. The handles are mounted on handle plates, each functioning independently of the other. The handle plates are connected to two inner operating plates, and at least one pin is fixed to each of the inner plates. When any of the handles is pushed or pulled, the cam operates the latch inwardly to open the door.

3 Claims, 3 Drawing Sheets

SINGLE ACTION HANDLE MECHANISM FOR OPERATING THE DOOR/WINDOW

BACKGROUND

Figure 1A:
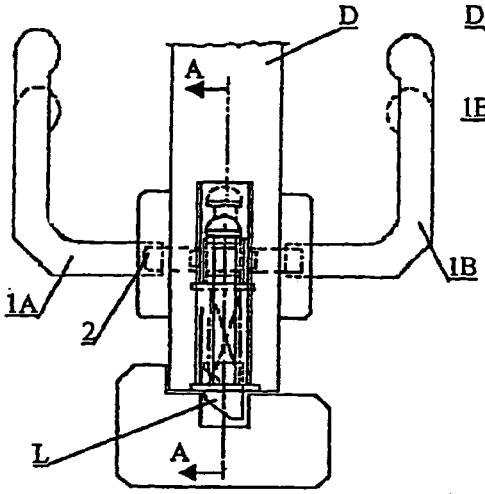
Fig. 1(a) (PRIOR ART)
Figure 1B:
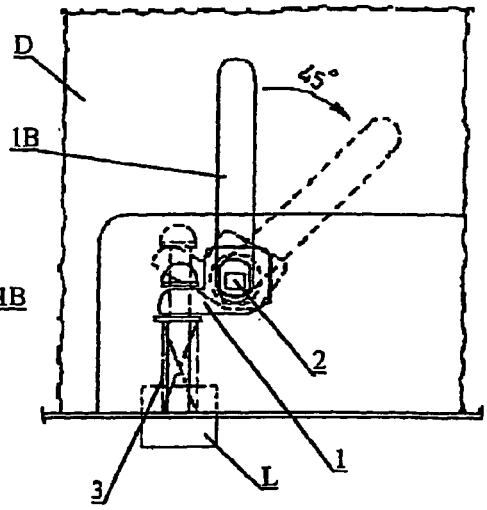
Fig. 1(b) (PRIOR ART)
Figure 1C:
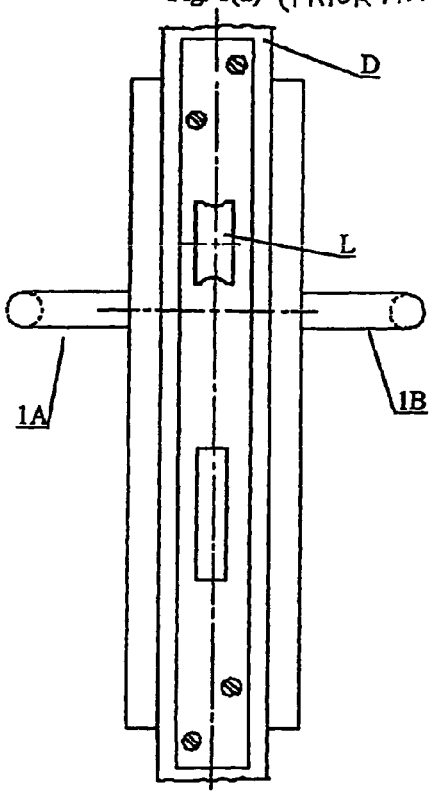
Fig. 1(c) (PRIOR ART)

The conventional door/window handles operate on the double action mechanism for operating the door or window. The conventional door/window handle mechanism is shown in FIGS. 1*a*, 1*b* & 1*c* of the accompanying drawings. It consists of handles (1A, 1B), which are interconnected with a connecting rod (2) such that when handle (1A) moves, the handle (1B) also moves. The said handles are connected to a cam (1), which operates the spring loaded latch (L). On rotating the handle, (1A or 1B) downward to the extent of about 45°, it retracts the latch (L) from door frame against the compression spring (3). On releasing the handles (1A, 1B), latch (L) comes out due to said spring pressure on latch (L). To open the door or window, two actions are required, viz., firstly the handle has to be rotated downwardly for about 45°, and secondly a simultaneous push or pull is required to open the door/window.

The drawback of the conventional door/window handle mechanism is that the handle(s) mounted in front and back of the door are connected by a connecting rod (2) resulting in more wear and tear of handle assembly. Furthermore, a single handle can not be used in case of a window.

The object of this invention is to obviate the aforesaid drawback.

Further object of this invention is to provide a single action handle mechanism.

Yet another object of this invention is to provide handles functioning independently of each other.

To achieve the said objectives this invention provides a single action handle mechanism for operating the door/window comprising two handle connected to a cam which operates the spring loaded latch characterized in that:

said handles are mounted on handle plates, each handle functioning independently of the other, said handle plates are connected to one or more inner operating plates, and at least one pin fixed to each of said inner plates such that when any of said handles is pushed or pulled, said pin(s) swings to rotate the cam, which operates the latch inwardly to open the door/window.

A separate lock is provided in said mechanism to lock the door.

A spring is provided with the latch to operate the door in single action.

The said handles can be of any desired shape.

The invention will now be described with reference to the accompanying drawings:

FIGS. 1*a*, 1*b* & 1*c* show the conventional door/window handle mechanism for operating the door/window.

Figure 2A:
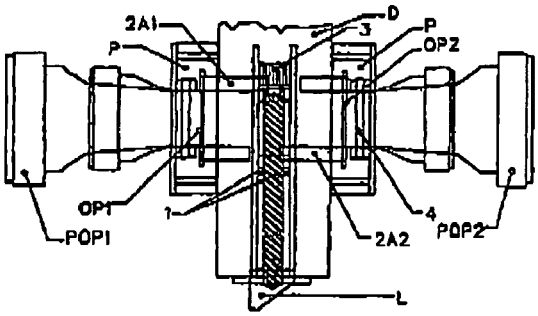
Figure 2B:
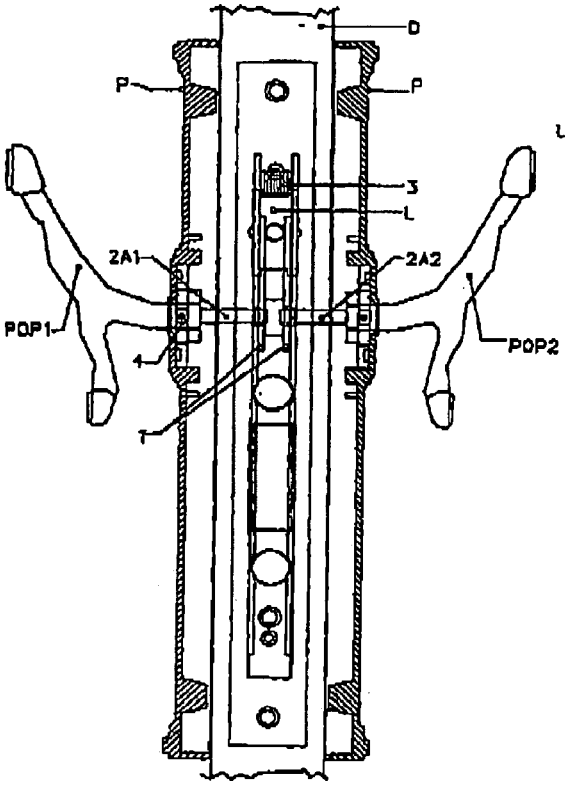
Figure 2C:
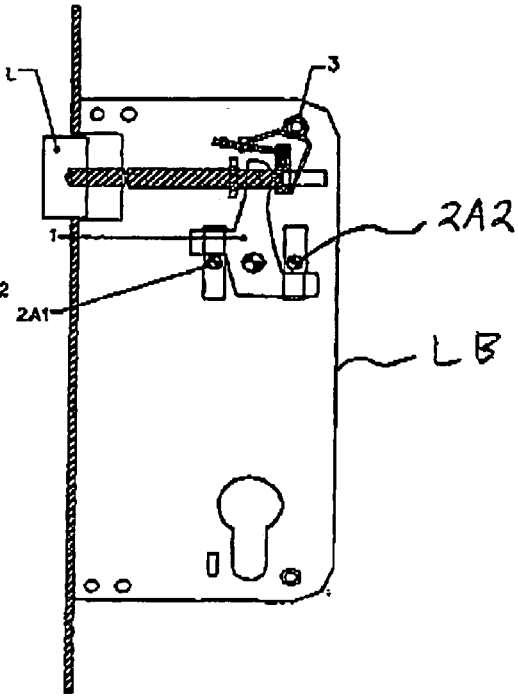

FIGS. 2*a*, 2*b*, 2*c* show the single action handle mechanism for operating the door/window, according to this invention.

Figure 3C:
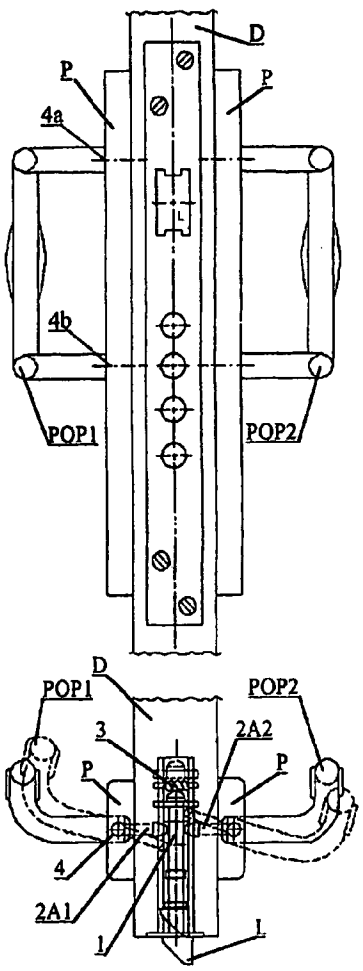
Figure 3B:
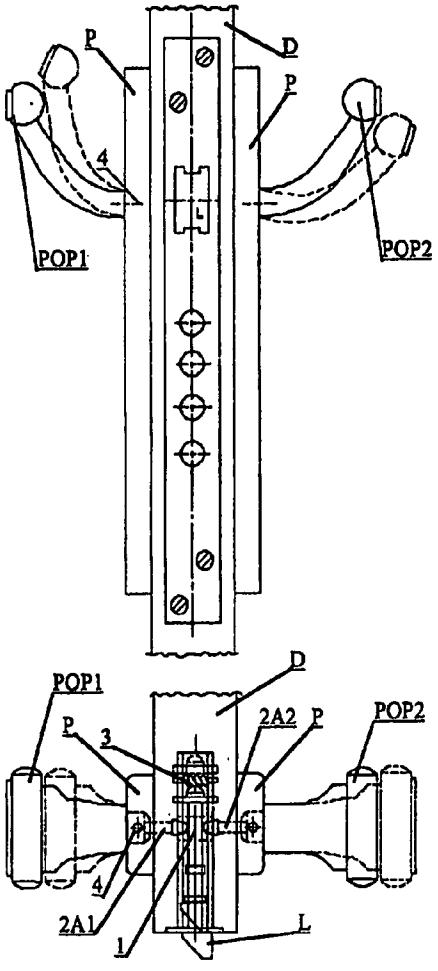
Figure 3A:
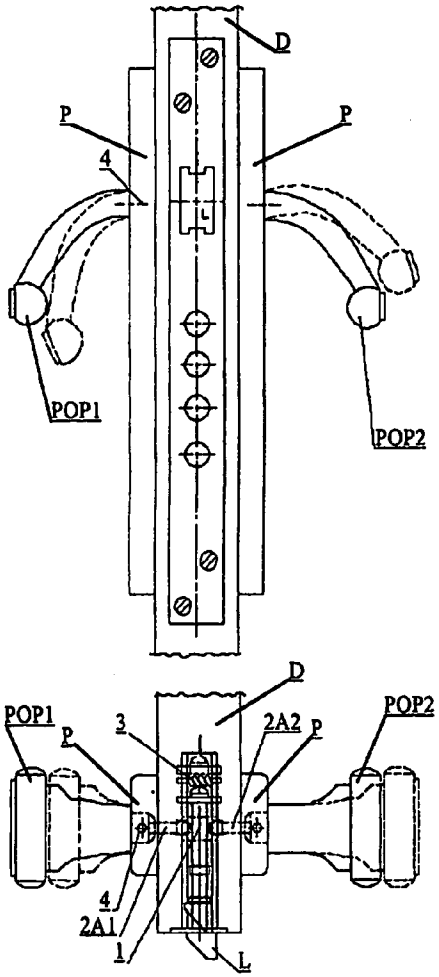

FIGS. 3*a*, 3*b* & 3*c* shows the type of handles for a single action handle mechanism for operating the door/window, according to this invention.

DETAILED DESCRIPTION

The conventional door/window handle mechanism has been described under the heading 'background'.

FIGS. 2*a*, 2*b* & 2*c* describe a single action door/window handle mechanism. According to this invention, the handles (POP1, POP2) mounted on handle plates (P) and connected to inner operating plates (OP1, OP2) and are provided for push/pull action simultaneously. The handles operate independently of each other, as they are not interconnected. Pins (2A1, 2A2) are attached to the inner operating plates (OP1, OP2) and the handles (POP1 and POP2) are connected to the opposite side of said inner operating plates. On pushing/pulling the handle (POP1 or POP2), pins (2A1, 2A2) attached to the operating plates (OP1, OP2), swings the cam (1), which retracts the latch (L) against the spring (3), which in turn releases the door (D)/window (W) in a single action. On releasing the handle (POP1 or POP2), the latch (L) comes forward due to the spring force. The cam (1) and latch (L) are operating inside the lock body (LB).

Handles (POP1, POP2) are connected to two pivots (4*a* & 4*b*) or at a single pivot (4), as shown in FIGS. 3*a*, 3*b* & 3*c*. The handles (POP1, POP2) can be of different designs shown in FIGS. 2*a*, 3*b* and 3*c*.

The position of handles can be changed around 360° in one plane, as shown in FIG. 3*c* without any basic change of operating mechanism, to create different models of door/window operating mechanism to suit the customers. This mechanism has application for hotels, restaurants and office buildings and is convenient for operation.

The invention claimed is:

1. A handle mechanism for operating a door or a window comprising:

a pair of opposing handle mounting plates;

a pair of swinging handles, each swinging handle being mounted to a respective handle mounting plate for swinging movement;

a pair of inner operating plates, each inner operating plate coupled to a corresponding swinging handle for movement based upon swinging movement of the corresponding swinging handle;

a pair of pins, each pin coupled to a respective inner operating plate and moveable therewith;

a cam rotatably mounted between said inner operating plates for rotating movement based upon movement of said pair of pins; and a latch biased in an extended position and movable to a retracted position based upon rotation of said cam;

said cam being configured and cooperating with said pins so that movement of a given pin rotates said cam to retract said latch independently without movement of the other pin whereby each swinging handle moves independent of the other swinging handle.

2. The handle mechanism of claim 1, further comprising a lock for locking the handle mechanism.

3. The handle mechanism of claim 1, further comprising a spring for biasing said latch in the extended position.

* * * * *